United States Patent [19]

Soderberg et al.

[11] 4,321,867

[45] Mar. 30, 1982

[54] ELECTRO-MECHANICAL LATCH APPARATUS

[75] Inventors: John H. Soderberg, Monroe, N.Y.; Leonard M. Penque, Huntington, Conn.

[73] Assignee: Pitney Bowes Inc., Stamford, Conn.

[21] Appl. No.: 225,083

[22] Filed: Jan. 14, 1981

[51] Int. Cl.[3] ..... B41J 1/22

[52] U.S. Cl. ..... 101/91; 101/110

[58] Field of Search ..... 101/74, 75, 45, 91, 101/95, 99, 110; 235/101

[56] References Cited

U.S. PATENT DOCUMENTS

| | | | |
|---|---|---|---|
| 2,829,591 | 4/1958 | Rouan | 101/91 |
| 3,583,314 | 6/1971 | Gillender et al. | 101/91 |
| 3,589,281 | 6/1971 | Woodhead | 101/91 |
| 3,616,749 | 11/1971 | Ritzerfeld | 101/91 |
| 3,682,378 | 8/1972 | Rouan et al. | 101/91 |
| 3,861,302 | 1/1975 | Mizutani et al. | 101/110 X |
| 3,882,735 | 5/1975 | Shimodaira et al. | 101/110 X |
| 4,050,374 | 9/1977 | Check, Jr. | 101/110 X |
| 4,050,375 | 9/1977 | Orlens | 101/110 |
| 4,259,902 | 4/1981 | Ecuert, Jr. et al. | 101/91 |

*Primary Examiner*—E. H. Eickholt

*Attorney, Agent, or Firm*—Peter Vrahotes; William D. Soltow, Jr.; Albert W. Scribner

[57] ABSTRACT

An electro-mechanical latch apparatus is provided for selectively and sequentially moving and locking a latch member into a desired position, and then unlocking and returning said latch member to its original position, by energizing an electrical pulse means in contact with said latch apparatus.

4 Claims, 9 Drawing Figures

22
5
35
25
30
6
33
32
51
56
10
13
46
52
36
39
58
45
41
17
19
47
40
38
26
53
4
50
18
31
59
55
16
37
40
43
15
19a
21
20
49
54
44
34
48
42
24
27
29

22
5
35
25
30
51
56
10
13
33
32
36
52
58
41
39
46
45
47
19
18
38
53
19a
55
4
17
31
59
43
6
37
54
16
21
20
49
40
15
44
34
48
42
24
27
29

22

35
25
30
33
51
58
36
41
56
39
46
47
53
32
38
55
30
54
31
37
59
43
49
40
44
34
6
48
5
10
42
4
24
15
27
13
17
18
16
19
21
19a
28
29
20

4
5
6
10
15
13
24
18
17
27
16
19a
21
19
28
29
20
22

27
25
35
30
32
33
51
36
39
58
45
40
56
57
52
41
38
59
31
47
37
50
49
46
54
53
40
55
44
24
48
34
43

ELECTRO-MECHANICAL LATCH APPARATUS

BACKGROUND OF THE INVENTION

This invention represents an improvement in postage register printing systems, specifically those which print values on a sheet, tape or stamp, by means of print wheels housed in, and protruding from, a rotatable printing head. More specifically this invention represents an improvement in devices of the type in which at least one print wheel bank is automatically advanced a pre-set amount by means of the rotation of the printing head.

However, it will become clear as this invention is described, that the improvements recited herein are applicable to any printing system or device in which the printing dies are contained on a wheel or set of wheels which are rotated to set the value or values to be printed.

The improvements herein will be described with relation to the type of postage register printing systems which, in addition to printing the postage to be affixed to a given parcel, also print numbers to identify parcels on the same postage stamp of tape. As is generally well known in this field, modern postage printers are controlled electronically by micro-processing technology; however, the improvements herein are equally useful or applicable in mechanical or semi-mechanical mode.

Typical postage printing systems are disclosed in U.S. Pat. No. 2,829,591, showing a printer with a rotatable printing head containing print wheels; and U.S. Pat. Nos. 3,965,815 and 4,050,374, which shows and describe various setting mechanisms for setting the print wheels in a postage meter, and thus fixing the postage amount to be printed. Electronic control systems for automatically carrying out the functions of a postage printing system have been designed, such as that disclosed in U.S. Pat. No. 3,978,457.

Two common types of postage value printers in use today are used by the United States Postal Service and by the United Parcel Service (UPS) respectively. In the Postal Service device, such as the Pitney-Bowes Model 5300, shown in U.S. Pat. No. 2,829,591, there are four print wheels in a postage print wheel bank which can provide a postage impression up to $99.99. Each print wheel provides a separate digit of this sum, and is settable from 0–9. Setting mechanisms include those disclosed in the foregoing patents. The actual print impression process by which the printing drum rotates to stamp a postage value on a substrate is described in said U.S. Pat. No. 2,829,591.

However, in the UPS device, in addition to the bank of postage print wheels, there is an additional bank of print wheels laterally spaced along the drum from the postage print wheel bank, for impressing a parcel identification number (PIN) near the postage amount on the postage stamp. The PIN information and accumulated postage are stored in the printer by known means, and in this manner, UPS can estimate the average postage normally used per parcel over a period of time, by dividing the accumulated postage by the total PIN count. Additionally, the PIN of course provides a number to identify and follow the parcel through the delivery process.

The PIN print wheel bank is typically automatically set, or advanced, by the rotation of the printing drum around a stationary cam attangement. Every rotation of the drum, which in these printers corresponds to one postage impression, produces a PIN increase of one by the interaction of the PIN print wheel bank with the stationary cam. By the positioning of the cam, the PIN counter may be advanced one unit either at the end of a drum rotation, so as to show the next PIN in advance of the next drum rotation, or at the start of or during drum rotation. If it is the latter, when the drum is in a rest position, the PIN print wheel bank will show the previous PIN. As will become clear hereafter, this is the PIN count mode desired in apparatus encompassing the present improvements.

Thus, it can be seen that one PIN is printed out sequentially every time the drum is rotated once to print postage or other information. It is in the latter instance that the problem arises which is solved by the inventive improvements described and claimed herein.

Ideally, the printer operator would like to have the PIN count correspond exactly to the number of parcels to which postage has been affixed over a given period of time, and to have one PIN identify, or be unique, to a given parcel. However, for example, when a parcel is sent "cash-on-delivery" (COD), the postage register must be activated twice: once, to print out a proper postage as usual, and again to stamp out an additional charged amount when the parcel is delivered (COD stamp). Obviously, since the printing drum is rotated twice in the case of a COD parcel, two consecutive PINS will be indicated on the two stamps of this one parcel. Clearly, the more COD parcels sent during a given period of time, the less the PIN count will correspond to the actual number of parcels posted. For record keeping purposes, it is desirable that one PIN be used per parcel, even if that parcel is sent COD with two stamps. In other words, for COD of similar situations, where multiple stamps must be affixed to one parcel, a given PIN should be repeatable for each stamp placed on a given parcel.

OBJECTS OF THE INVENTION

It is therefore an object of the present invention to provide means for selectively inhibiting the movement of an automatically-advanceable print wheel bank during the print mode of a value printing device.

More particularly, it is an object to provide means for selectively inhibiting the movement of the parcel identification numerical register in a postage registration printing device, during the rotation of the printing head in the print cycle.

It is a further object to provide with such inhibiting means a cancellation capability to enable the operator of the printing device to cancel the inhibition mode after its selection before the print cycle begins.

It is a further object to provide an electro-mechanical device external to the printing head which will activate or unlock the inhibiting means for each print cycle in response to an electrical signal energized by the operator.

SUMMARY OF THE INVENTION

The above objects and others are achieved and exemplified by providing, in the rotatable printing drum of a postage registration printing device, an edged member adjacent the parcel identification print wheel bank, which is engageable with the print wheels so as to lock the wheels against movement when the printing drum is rotated to print. Means are provided for selectively locking said member in engagement with the print wheels during the printing step.

Means, including said electro-mechanical device, are also provided to enable the operator of the printer to select and then cancel the inhibition mode before the printing cycle.

DESCRIPTIONS OF THE DRAWINGS

DESCRIPTION OF THE INVENTION

Figure 1:
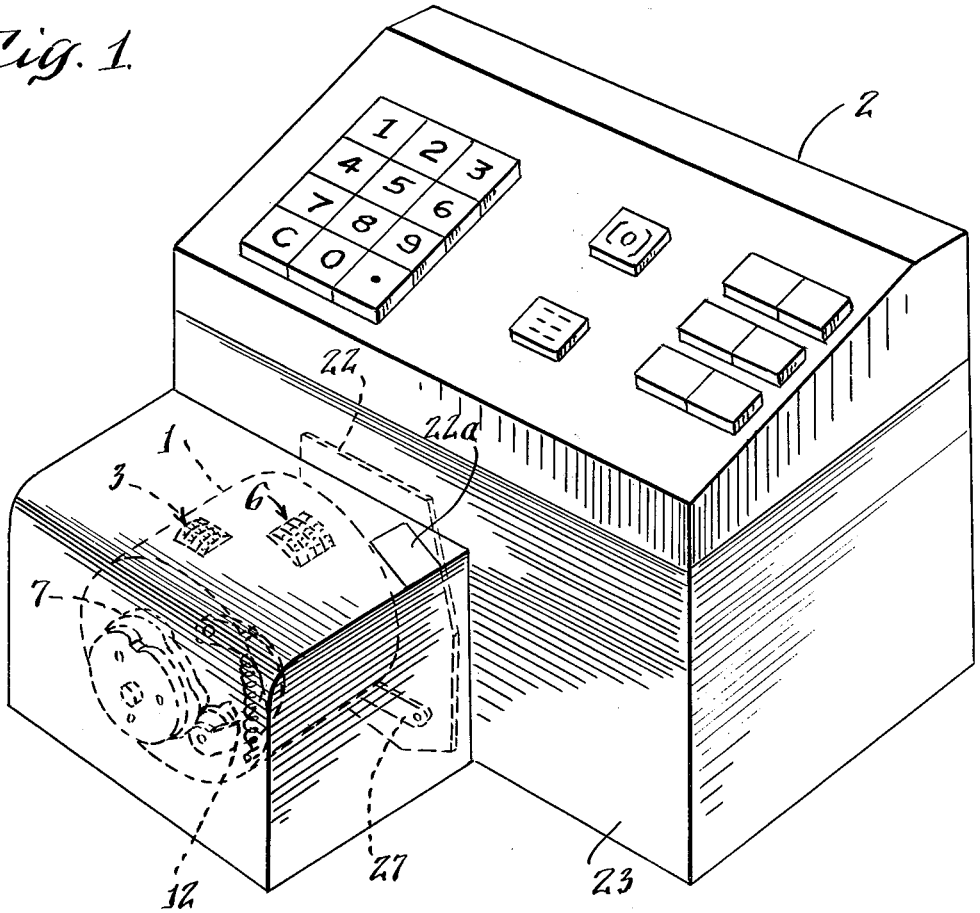
FIG. 1 is an external view of a postage register printer showing the printing head beneath the housing for same.

Referring now to FIG. 1, the printing drum 1 of a postage registration device 2 such as used by the UPS, is shown in dashed lines beneath its cover. A typical commercially available register is the Pitney-Bowes Model 6500. The printing drums carries two banks of print wheels 3 and 6 for impressing postage and parcel information on a sheet, tape, stamp or letter, to be affixed on a given parcel. Print wheel bank 3 consists of four or five print wheels for registering and printing postage values on a substrate and print wheel bank 6 consists of 3 to 6 print wheels for registering and printing the parcel identification number (PIN) on the same substrate. Each print wheel contains raised characters to be printed, each character is separated from the others by a V-shaped concavity. Typically in the register depicted and referred to herein, each print wheel contains raised numbers from 0–9, which means that the PIN print wheel bank 6 with 4 print wheels can go up to a PIN of 9,999.

The postage print wheels are settable to register a desired postage amount by gear and gear drive means internal to the register, not shown, just before the print cycle. This function, and indeed all functions of a modern postage printer, can be activated and controlled electronically by micro-processing circuitry, such that an operator can adjust all functions by simply pushing a button or series of buttons on the printer's console, as shown on the register 2 in FIG. 1.

Figure 2:
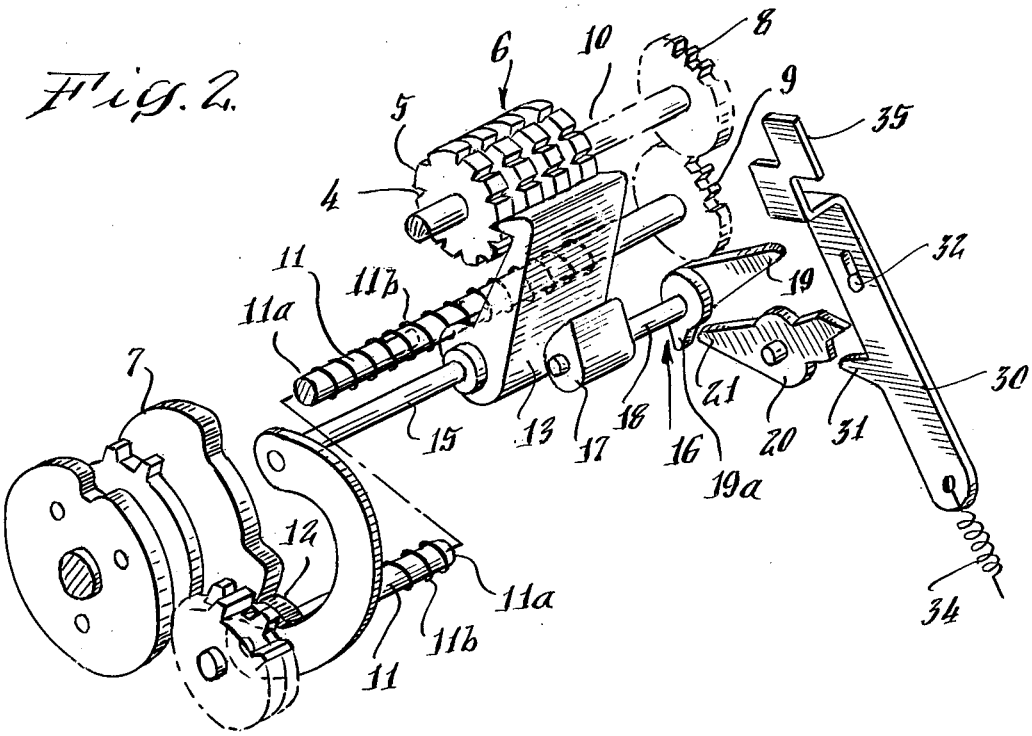
FIG. 2 is a schematic illustration of the inside of the printing head with the print wheel and drive mechanism split away for easier explanation and showing the improvements of this invention.

The PIN print wheel bank, as stated before, prints one parcel identification number for a given postage impression. Since the PINS proceed in sequential increments of one, postage registers have been designed so that the PIN print wheels advance automatically with each revolution of the printing drum. As before stated, the effect is that the PIN for the next parcel is automatically set at the end of the last, or previous, printing cycle. This is illustrated in FIGS. 1 and 2. Printing drum 1 rotates counter-clockwise as shown around stationary cam assembly 7. The PIN print wheel bank 6 is driven by gear wheels 8 and 9 riding on shafts 10 and 11 respectively. The other end of shaft 11 is connected to wheel 12, which rides tangentially on cam 7, and as drum 1 rotates and wheel 12 encounters the camming portion of cam wheel 7, gear wheels 8 and 9 interact to cause the PIN print wheel bank to advance one unit. By selective positioning of the cam assembly 7, the PIN print wheel bank can be made to move before or just after the printing step of the printing drum rotation. In any event, with this arrangement, there is no way that a given PIN may be repeated on the next cycle or succeeding cycles. As before explained, this is desirable where two or more stamps are to be affixed to a given parcel as in the COD situation.

Figure 3:
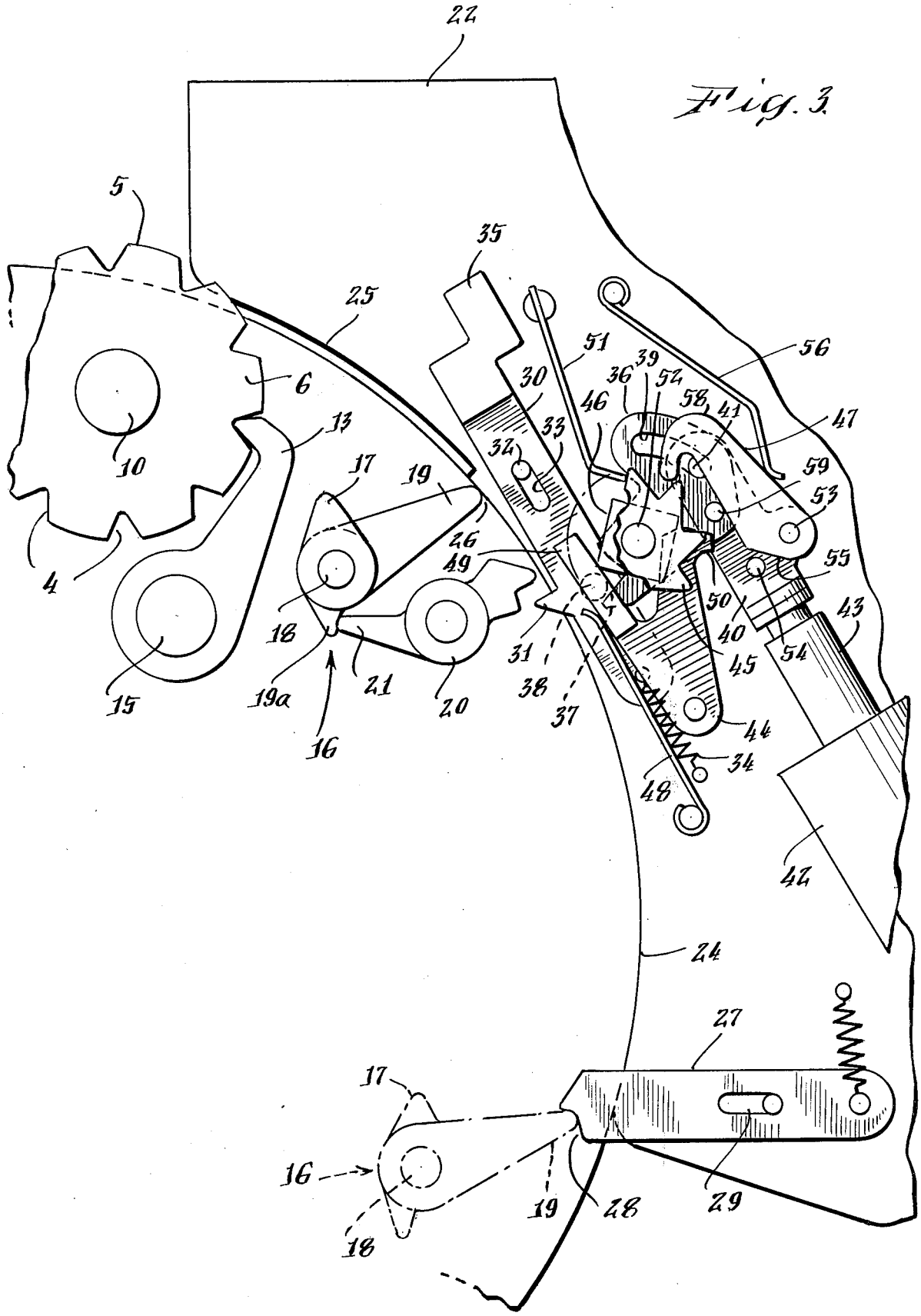
FIGS. 3–7 are schematic views of the printing head with the inventive improvements, in cross-section, as the printing head moves through one print cycle.

The present invention makes this possible, and we now refer to FIGS. 2 and 3. An edged member such as a pawl 13 is mounted inside the printing drum 1 by any suitable means adjacent the PIN print wheel bank 6. The pawl 13 is spring loaded or otherwise biased away from the PIN print wheel bank (see FIGS. 2 and 3), such as by spring mount and bracket 14 connected to the pawl by a shaft 15. Of course, this mounting implies that the pawl will rotate with the print drum 1 and will be fixed relative to the print wheel bank. The edge of pawl 13 is shaped to fit the concavities 4 between the raised characters 5 in the print wheels. Thus, when the printing drum is rotated, the pawl will be disengaged from the print wheel, just as the gear assembly advances the wheel, by the action of cam 7 and cam follower 12.

Means are provided to retain the pawl in locking contact with the print wheels 6 when it is desired to repeat a PIN on the next printing cycle. To do this, the cam assembly should be positioned to change the PIN at the start of the print cycle. Referring to FIGS. 1 and 3, such means comprise several spring-biased arm assemblies which, when fully freed to move as biased, will retain pawl 13 against the print wheels 6 so as to lock them against movement. For example, a first arm assembly 16, mounted in the printing drum 1, comprises an edged cam 17 mounted on a shaft 18 with a double edged cam 19. Cams 17 and 19 are fixedly mounted on the shaft 18 and will rotate as one when shaft 18 rotates. Arm assembly 16 is biased to rotate counter-clockwise and thus retain pawl 13 against the print wheels by contact of cam 17 against the pawl.

Arm assembly 16 is prevented from counter-clockwise rotation by a second arm unit comprising cam 20, which is mounted within the printing drum and is spring biased to move clockwise. In the rest position, that is, the inhibiting means is not activated, edge 21 of cam 20 is biased against cam 19 as shown, with the effect that the counter biases of arm assembly 16 and cam 20 prevent either from moving as biased. As shown, pawl 13 is in contact with the print wheels.

It is a further feature of this specific design that the shaft 11 connecting cam follower wheel 12 with gear wheels 9 and 8 and thus with the print wheel bank 6 is split in two at **11*a* and is fitted with a one way spring clutch 11*b***, for reasons to be explained below.

Referring now to FIGS. 1 and 3, a thin plate 22 is mounted on the front wall 23 of the postage register console within housing **22*a*, through and on which the printing drum 1 is mounted. The plate 22 has a curved edge with two circular arcuate portions 24 and 25. The curved edge of the plate is designed to frame the printing head, such that the longer edge of cam 19 abuts and is restrained by plate 22 at circular arc 24, and if cam 19 is moved past circular arc 24 into arc 25, it will be free to rotate as biased when not otherwise restrained. Plate 22 must by so positioned with respect to the printing drum that it will not contact the body of the printing drum and thus restrict movement of the drum frictionally. Therefore arc 24 of plate 22 should be concentric with the circular plane of the printing drum, but should have a radius just slightly larger than that of the printing drum cylinder if plate 22 overlaps the printing drum. However, if the side of the printing drum adjacent the front wall 23 of the console is spaced from it an amount slightly greater than the thickness of plate 22, then the radius of the circular arc 24** may be equal to that of the printing drum cylinder. This is in fact the situation illustrated in the drawing and the mode which will be referred to hereafter.

In either event, the radius of arc 25 is greater than that of arc 24 by an amount sufficient to permit cam 19 to rotate counter-clockwise as biased if it is free to move, without contacting arc 25 as it rotates.

Referring to FIG. 1, a housing 22*a*, containing the latch apparatus seen in FIG. 3 to the upper right of, and just outside of arc 24, is mounted on plate 22 and is stationary with respect to the printing drum. The latch apparatus will be described later.

FIG. 3 illustrates a rest position of the postage register printing drum, in cross-section. Pawl 13 is biased to leave, but is still in contact with print wheels 6, and arm assembly 16 is prevented from licking pawl 13 in inhibiting contact by cam 20. The purpose of plate or frame 22 is the provision of an inhibition cancellation function in the device. Clearly, if cam 20 is forced to move counter-clockwise such that edge 21 is brought out of contact with the shorter edge of cam 19, then arm assembly 16 would rotate counter-clockwise and lock pawl 13 into contact with print wheels 6. If the postage register operator should change his mind and wish to cancel the PIN print wheel inhibition, this would not be possible without considerable mechanical effort.

Therefore, with plate 22 provided as shown, and the longer protruding edge of cam 19 in contact with plate 22 at arc 24, cam 20 may be moved out of contact with arm assembly 16 without irrevocably commiting the apparatus to the inhibiting mode. Cam 19 will still be prevented from moving counter-clockwise by the contact at point 26 of its longer edge with arc 24.

If the printing drum 1 is moved counter-clockwise such that cam 19 is moved past arc 24, then the arm assembly 16 is free to rotate counter-clockwise and lock pawl 13 into print wheels 6 to prevent them from moving. As the printing drum rotates and begins to return to its rest position, the arm assembly 16 is restored to its initial position by a counter-clockwise-spring-biased link 27 mounted on plate 22 and rotatable about pin 29. Link 27 is arranged so as to contact cam 19 at contact point 28 as the printing drum rotates the arm assembly 16 past that point. The contact 28 forces cam 19 to move clockwise far enough to be slid back into locking contact with cam 20 (see FIG. 7) and back into contact with arc 24 as the printing head returns to its rest position. The pawl is still in contact with the print wheels due to cam follower 12 and cam 7, even though not now in the inhibition mode.

It is thus seen that a dual cancellation function is provided in the postage register printing system by the interaction of plate 22 and link 27 with cam 19. To summarize, the PIN print wheel inhibition mode may be selected by urging cam 20 out of contact with cam 19, and while the printing drum remains in its rest position, said mode may be cancelled by simply allowing cam 20 to spring back into contact with cam 19. Cam 19 has been prevented from movement by means of its contact with arc 24. And again, if the inhibition mode has been selected and utilized during the print cycle, it is automatically cancelled after the printing drum has rotated through the printing step and is returning to its rest position by means of cam 19 contacting link 27 and forcing cam 19 back into locking contact with cam 20.

A further feature of this invention is the latching apparatus pictured in FIGS. 2–6, and FIGS. 8–9. This aspect of the present invention will be described shortly, but first we shall describe the function and purpose of the split shaft 11 fitted with a one way spring clutch 11*b*.

In postage register printers currently available, the PIN print wheel bank is designed to move at least one unit every time the printing head is rotated to print. FIG. 2 illustrates the interconnection of parts by which the print wheel bank is driven to move when cam follower wheel 12 encounters the camming portion of stationary cam 7. Clearly, if an inhibition apparatus is provided to prevent the PIN print wheel bank from moving as usual, then some provision of flexibility must be provided in the means which normally drive the PIN print wheel bank to advance. Otherwise, considerable friction and eventual breakdown of at least a part of that driving means will occur by preventing the PIN print wheel bank from moving in response to the driving means. We solved this aspect of the problem by simply splitting shaft 11 at point 11*a* and providing shaft 11 with a one-way spring clutch, such that shaft 11 is sufficiently constrained to move as a unit and drive the PIN print wheel bank when the inhibition mode is not selected. However, when the inhibition mode is in place, the right side of shaft 11 is prevented from moving by pawl 13 preventing print wheel bank 6 from moving, but the one-way spring clutch permits the left side of shaft to move when urged to do so by interaction with cam 7. Thus, no interference with the rotation of the printing drum occurs when the inhibition mode is activated.

Thus it is clear that the first step in activating the PIN print wheel bank inhibitor is to disengage cam 20 from cam 19 by rotating cam 20 counter-clockwise against its bias until it has cleared point 21 where it makes contact with cam 19. Cam 20 must then remain in the disengaged position until the printing drum is rotated far enough for cam 19 to enter arc 25. As said before, at that position cam 19 and arm assembly 16 would then snap quickly counter-clockwise and lock pawl against the print wheels 6. Electro-mechanical apparatus is thus provided to control the movement of cam 20, and also to permit the printer operator to electronically select and/or cancel the PIN print wheel inhibition mode. The apparatus is pictured in FIG. 3–6 and is mounted on plate 22 at the rest position of the printing drum; that is, adjacent cams 19 and 20. This latch or trigger mechanism is shown in greater detail in FIG. 8 and in even greater detail in FIG. 9, wherein the parts are shown in broken away fashion for ease of understanding their interaction.

The object of this apparatus is to provide in effect an "on-off" inhibition selector, such that when the "on" mode is desired, cam 20 will be forced out of contact with cam 19 for as long as the "on" mode is desired. When it is desired to cancel the inhibition mode, the apparatus will permit cam 20 to return to its normal biased position, such that it will again inhibit cam 19 and arm assembly 16 from locking pawl 13 into contact with the print wheels.

Figure 8:
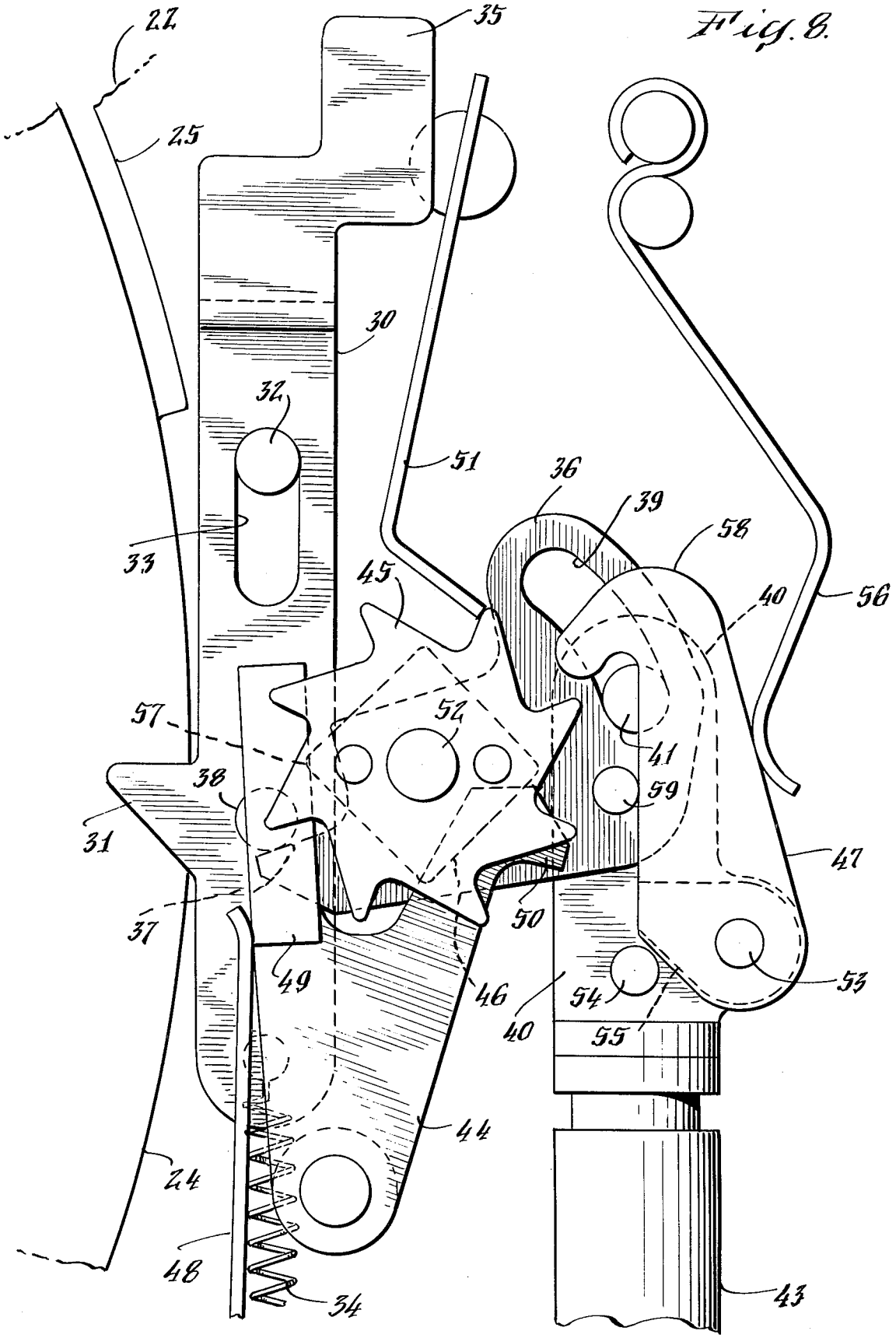
FIG. 8 is a planar view of the electro-mechanical latch of this invention, with the parts in super-position.
Figure 9:
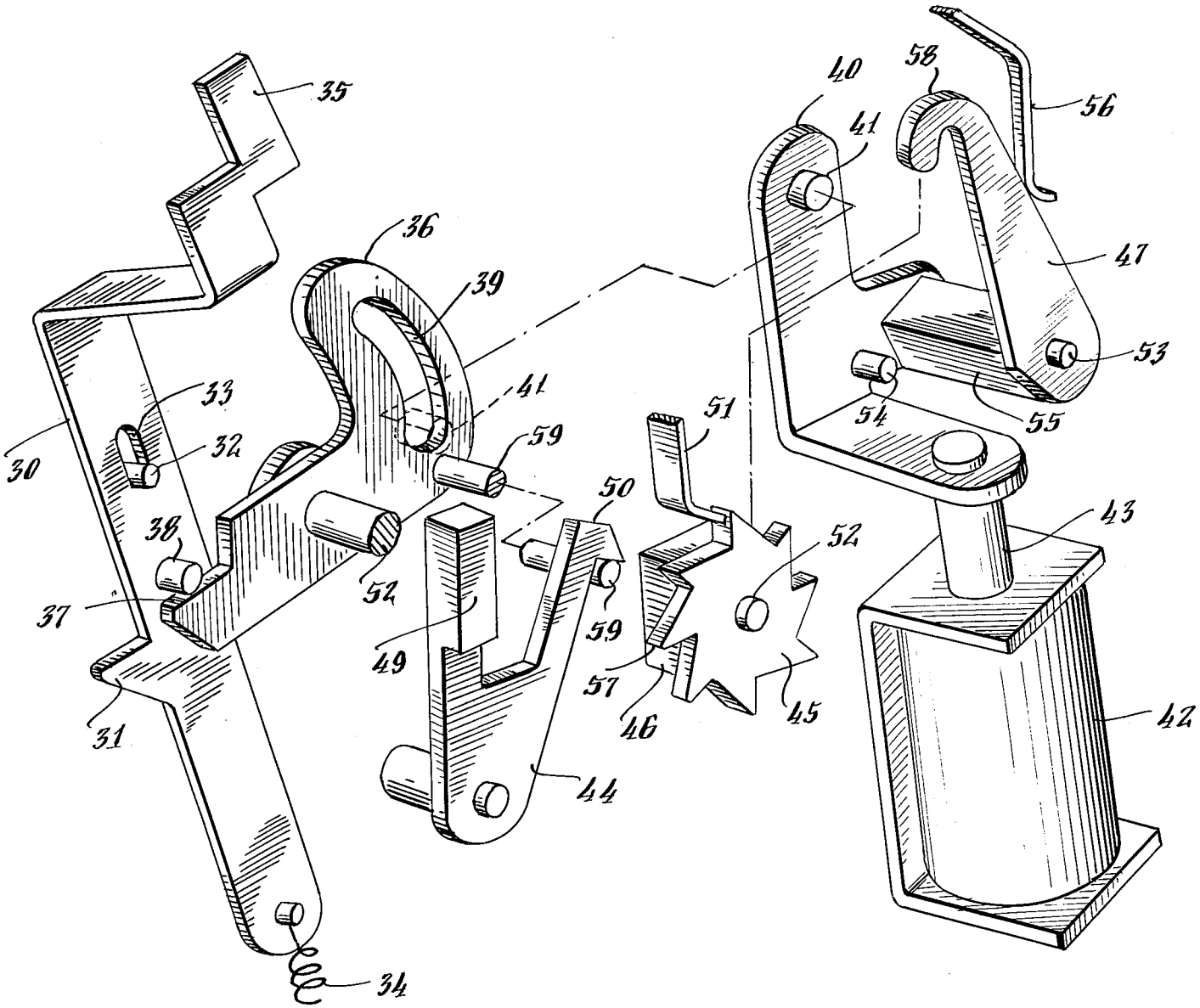
FIG. 9 is the electro-mechanical latch with the parts broken away for easier illustration.

Referring now to FIGS. 8 and 9, as stated before, FIG. 8 shows the assemblage of parts in their normal superimposed arrangement as in the actual device, and FIG. 9 shows the parts broken away. Referring to FIG. 9 first, a latch 30 is mounted flush to plate 22, or other support surface, and is permitted to move up or down such that trigger 31 is brought into contact with the edge of cam 20. Up or down movement of the latch 30 is restricted by a pin 32 which protrudes from the mounting plate through slot 33 in the latch. The lower end of latch 30 is spring-mounted as shown, such that spring 34 will tend to pull the latch in the downward direction and, in the absence of other forces acting, will keep the upper portion of slot 33 in firm downward contact with pin 32. The upper end 35 of the latch 30 is a brace extending outward from the latch and is designed for movement in and out of a photo-sensing device which is not shown here.

The movement of latch 30 in the upward direction is directly caused by a second latch 36, which is rotatably mounted on plate 32, or other support surface, by shaft 52, and is not biased to rotate in any particular direction. Edge 37 of latch 36 contacts a pin 38 wwhich is fixed on latch 30 such that clockwise rotation of latch 36 forces pin 38 and thus latch 30 to move upward. When this happens, as we shall see, cam 20 will be moved out of contact with cam 19 and the inhibition mode will have been activated. Latch 36 is in turn caused to move or rotate clockwise by the downward action of link 40 which is so mounted that pin 41 of link 40 is permanently fitted to move within the curved slot 39 of latch 36. The base of link 40 is permanently mounted on a solenoid valve 42. An electric pulse of the valve 42 causes piston 43 to retract within the valve, that is, to move downward. Link 40 is braced against the support plate but is free to move up and down as the movements of the valve 42 dictate. Therefore, if valve 42 is pulsed or signaled, piston 43 and thus link 40 will move downward, causing latch 36 to rotate clockwise by the action of pin 41 within slot 39, and this will in turn of course cause latch 30 to move upward. As mentioned before, this would result in the activation of the inhibition mode, since the upward movement of latch 30 will cause cam 20 to move out of contact with arm assembly 16.

It is highly preferable to be able to leave latch 30 in the upward position for as long as the inhibition mode is desired to remain in effect. Without further means than have been described, the only way to achieve this would be to send a constant current through the solenoid valve such that piston 43 and link 40 will remin in the downward position. However, if the inhibition mode lasts any period of time at all, a constant source of current through the solenoid valve would burn the valve out after only several uses. Therefore, we have provided a locking mechanism such that one pulse of the solenoid valve will be sufficient to move and lock latch 30 in the upward position, and a second pulse will be sufficient to unlock latch 30 and let it return to its rest, or downward position.

The locking mechanism for latch 30 will now be described referring to FIGS. 8 and 9. A second link 44, a star wheel 45 having an edged cam 46 (e.g., a square cam) affixed to the back thereof, and a third link 47 are provided as shown. Link 44 is rotatably mounted to the support plate and is spring-loaded to rotate clockwise by the force of spring 48 against arm 49 of the link. The other arm of link 44 has a hooked end 50. Star wheel 45 and therefore square cam 46 is rotatably mounted to the support plate on the same shaft as latch 36 and is fitted between the two arms of link 44, as shown in FIG. 8. A spring 51 prevents the star wheel from being rotated counter-clockwise, but the star wheel is otherwise free of any biasing force. Shaft 52 is the mounting shaft for the star wheel, and for latch 36. Link 47 is rotatably mounted to link 40 by shaft 53. The rotational movement of link 47 is limited by pin 54 fixed to link 40 against which the blocked base 55 of link 47 abuts when the link rotates counter-clockwise. Link 47 is spring-loaded and biased to rotate counter-clockwise by spring 56.

The clockwise rotation of star wheel 45 causes link 44 to jog back and forth, as will now be described. As indicated before, star wheel 45 is rotatably mounted between the arms of link 44, such that the square cam 46 on the back of the star wheel contacts the left arm 49 of link 44 but it touches only the widened part of arm 49 and merely overlaps the right arm as in FIG. 8. Obviously, the star wheel portion itself is outside of and in front of the arms of link 44. In the rest position of the apparatus, the sides of square cam 46 are at approximately 45° angles with respect to the left arm 49 of link 44. This means that corner 57 of square cam 46 abuts left arm 49. This angle keeps link 44 in the position indicated in FIG. 8.

As can be seen, link 47 has a hooked upper end 58, and link 40, valve 42, and link 47 are mounted and positioned in the apparatus such that in the rest position the upper end 58 of link 47 is just above and slightly to the left (as viewed in the drawing) of a tooth of the star wheel, such that if link 47 is caused to move downward, it will engage said tooth and rotate the star wheel clockwise 45°. The key to the locking aspect of this latch apparatus is the engagement and disengagement of angled end 50 of link 44 with lock pin 59, which is permanently fixed to latch 36. Link 44 is so mounted on the support plate as to project further from the support plate than latch 36.

Therefore, when the solenoid valve 42 is actuated to cause this 45° rotation of the star wheel, left arm 49 of link 44 rotates clockwise due to the pressure of spring 48, and hooked end 50 slides up against and over lockpin 59 which has been moving downward in response to the pulse of the valve 42. This in effect locks the latch apparatus and latch 30 in the upward position.

Therefore to recapitulate the action of the latch apparatus we start with the apparatus in the unlocked rest position. Latch 30 is in the downward position with pin 32 against the upper part of slot 33. Latch 36 is in its upper position with pin 41 at the lower end of slot 39. Square cam 46 is at approximately 45° angles with respect to the left arm 49 of link 44, and link 44 is out of contact with latch 36.

When the apparatus is activated, the operator pulses the solenoid valve 42 and piston 43, link 40 and link 47 all move suddenly downward toward the valve. This action causes pin 41 to move downward in slot 39 and thus force latch 36 to rotate clockwise; simultaneously, the hooked end 58 of link 47 engages the star wheel tooth and causes the star wheel to rotate 45° clockwise. As latch 36 is rotated clockwise, it forces latch 30 to move upward until pin 32 is in the lower end of slot 33. The star wheel rotation allows link 44 to rotate clockwise just as lockpin 59 of latch 36 is moving downward. As described before, the angled end 50 of link 44 then slides against and over lockpin 59, locking latch 36 in the downward position and therefore locking latch 30 in the upward position. After the pulse generates this action, piston 43, link 40, and link 47 all return to their original positions. However, the apparatus is now locked with hooked end 50 of spring-biased link 44 preventing lockpin 59 and thus latch 36 from returning to their original positions.

To unlock the apparatus, the solenoid valve is again pulsed which causes link 47 to again rotate the star wheel 45°. At the same time pin 41 in slot 39 pulls latch 36 down just enough to allow link 44 to be pushed backward (rotated counter-clockwise), by cam 46 such that link 44 is now out of contact with lockpin 59 of latch 36. Thus, as the pulse ends and links 40 and 47 spring back to their original positions, latch 36 is free to rotate and therefore the spring 34 pulls latch 30 downward and pin 38 forces latch 36 to rotate counter-clockwise. The latch apparatus is then back in its original unlocked, rest position.

Thus, the latch apparatus provides a remote control method for activating and cancelling the PIN print wheel inhibition apparatus, as will now be more fully described. Referring to FIG. 3, the printing drum 1, the inhibition apparatus, and the latch apparatus just described are all in the rest position, with the inhibition mode inactive. As can be seen, cam 20 is in contact with cam 19 and arm assembly 16 at point 21, and arm assembly 16 is prevented from movement. Latch 30 is in the downward position with trigger 31 just below the edge of cam 20. If the postage register printer is activated to print, the print drum will rotate counter-clockwise, the PIN print wheel bank will automatically advance on unit as in the current or prior art devices and the print head will make an impression on a stamp approximately half way through its rotation. This print wheel movement occurs by the interaction of cam 7 and cam follower 12 permitting the spring biasing means 14 to move pawl 13 out of contact with the print wheels 6 just long enough for the wheels to be advanced by gears 8 and 9. Following disengagement, as the printing drum continues to rotate through the printing arc, and cam follower 12 leaves the camming portion of cam 7, pawl 13 is once again urged into contact with the print wheels. As the printing drum begins to return to its rest position, the inhibition apparatus will move past resetting link 27. But, the outer edges of cams 19 and 20 will slide up against and past point 28 with no change in the relative positions of the two cams. This is clear since the contact between cam 19 and link 27 would tend to rotate cam 19 clockwise and the contact between cam 20 and link 27 would then rotate cam 20 clockwise. This interaction of forces merely serves to accentuate the locking positions of cams 19 and 20. Link 27 also gives way a certain amount due to the pivot at 29. The spring at the end of link 27 of course returns the link to its original position.

Figure 4:
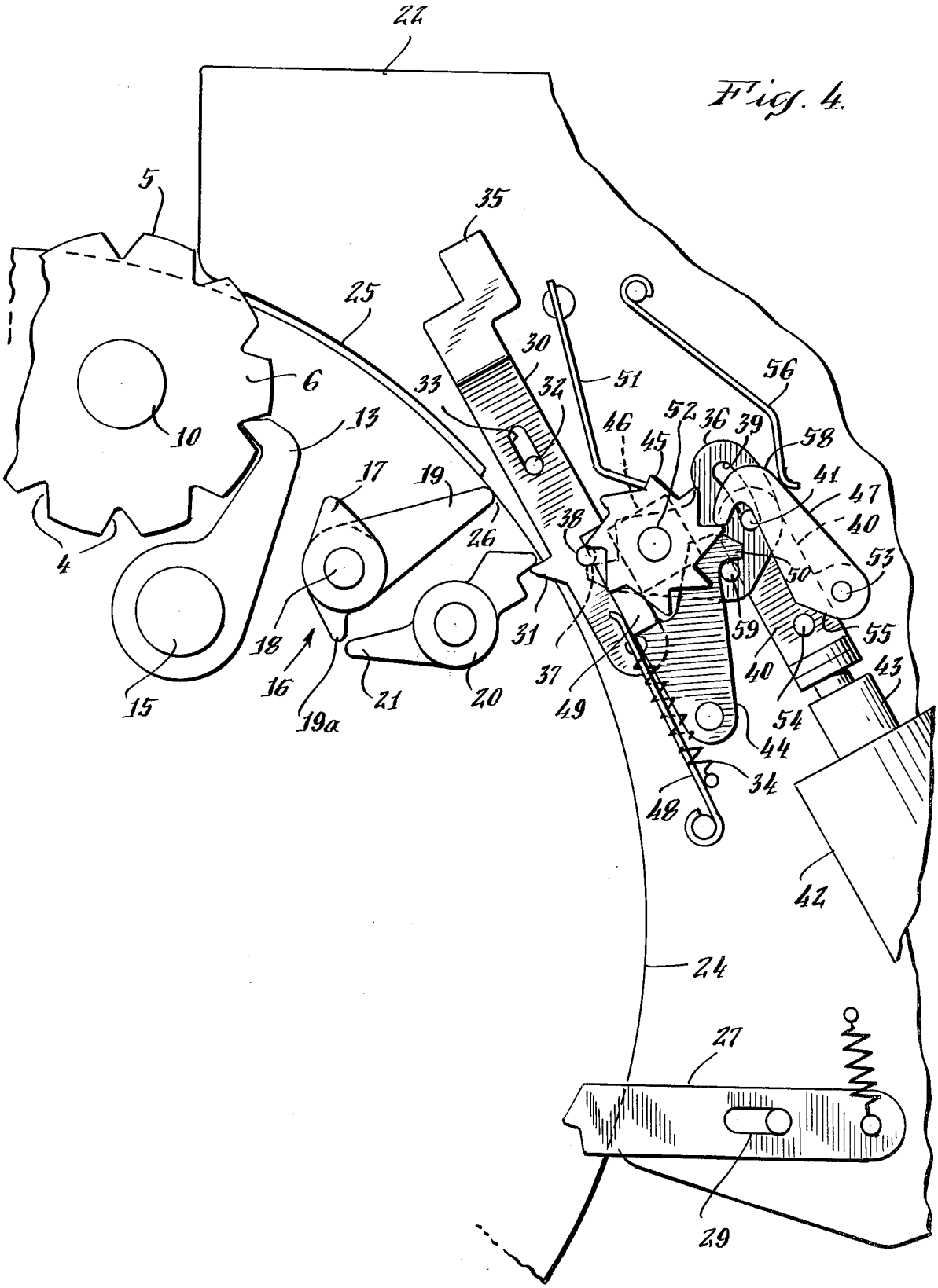

Referring now to FIG. 4, the operator now desires to repeat the previous PIN and wishes to select the mode which will inhibit movement of the PIN print wheel bank on the next printing cycle. Therefore, an electric signal is sent from the operator to the solenoid valve 42 which causes it to pulse and move latch 30 upward and to be locked in that position as previously described. Note that in the latch apparatus in FIG. 4, square cam 46 is now flush with the left arm 49 of link 44. Also note that link 44 is set in locking position over lockpin 59. The printing cycle has not yet been activated and the drum has not yet begun to rotate. Of course, the effect of having moved and locked latch 30 in the upper position, is that trigger 31 abuts the end of cam 20 and forces cam 20 to rotate counter-clockwise just enough that end 21 is cleared of contact with arm assembly 16 and cam 19. This is the situation pictured in FIG. 4.

However, cam 19 is still prevented from rotating counter-clockwise as it is biased, since its outer edge is in contact with plates 22 and arc 24 at point 26. Thus, the operator may still cancel the inhibition mode should the situation with the parcel involved by changed and it is desired that a new PIN be advanced when the printing cycle commences. All the operator need do to cancel inhibition, is to again pulse the solenoid valve 42 which, as before described, will unlock link 44 from lockpin 59 and allow latches 30 and 36 to return to their unlocked downward positions. This in turn permits cam 20 to rotate clockwise as biased and back into locking contact with arm assembly 16.

Figure 5:
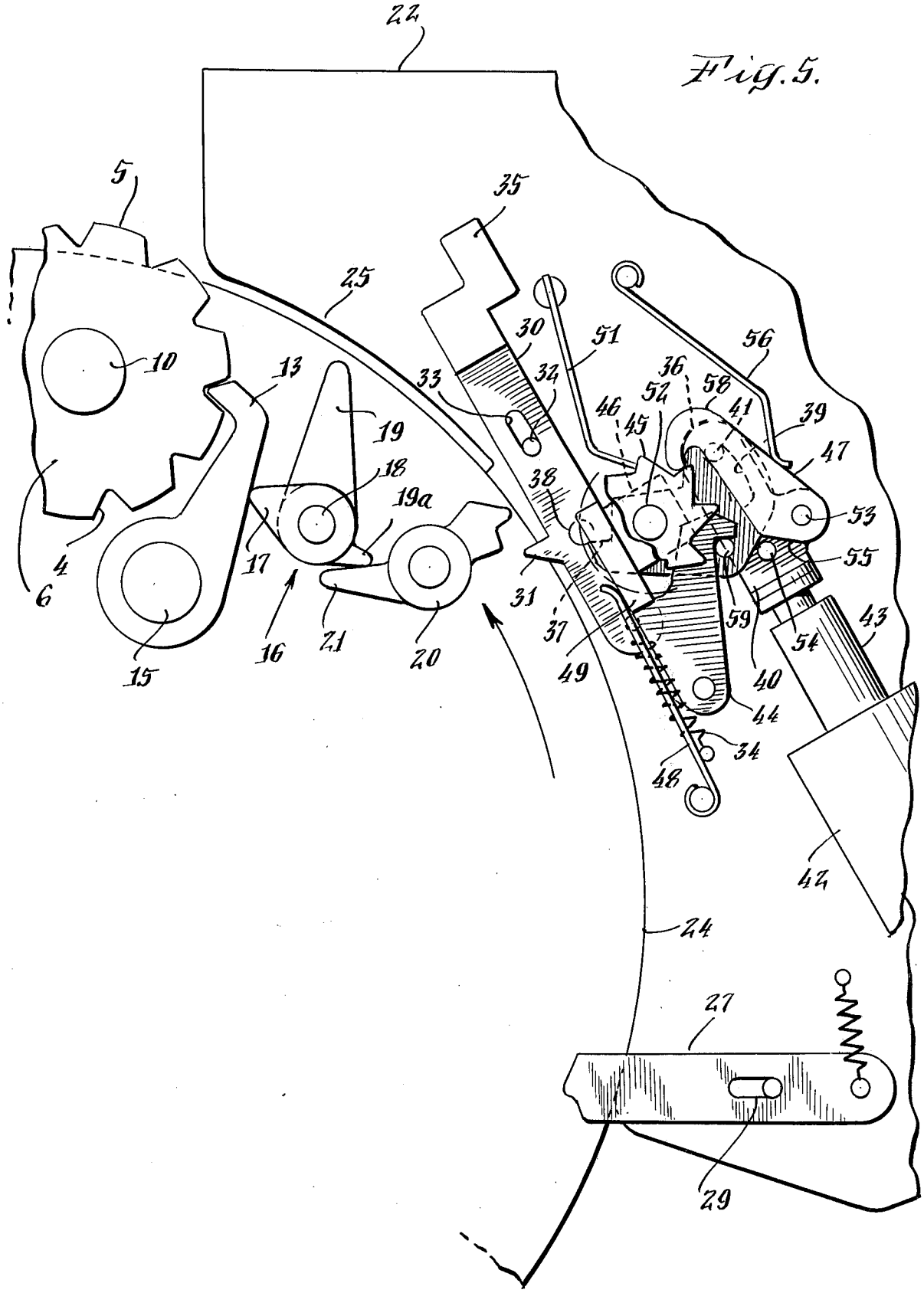

We now refer to FIG. 5 and the situation where the inhibition mode has been selected and the printing cycle begun. The printing drum has rotated counter-clockwise several degrees and just enough to allow the outer edge of cam 19 to enter circular arc 25. Arm assembly 16 and cams 17 and 19 then immediately rotate counter-clockwise as biased, and cam 17 then locks pawl 13 into locking contact with PIN print wheels 6. As the drum rotates, because of the split shaft and one way spring clutch arrangement previously described, the PIN print wheels do not advance since pawl 13 is not cammed out of contact with them during the printing cycle. When the cam follower 12 encounters the camming portion of cam 7, the spring mount cannot move pawl 13 out from the print wheels to allow advancement because of force of cam 17 against the pawl. Thus the wheels are inhibited. Again referring to FIG. 5, note that latch 30 and trigger 31 are still locked in the upward or inhibition activating position, with link 44 set over lockpin 59.

Figure 6:
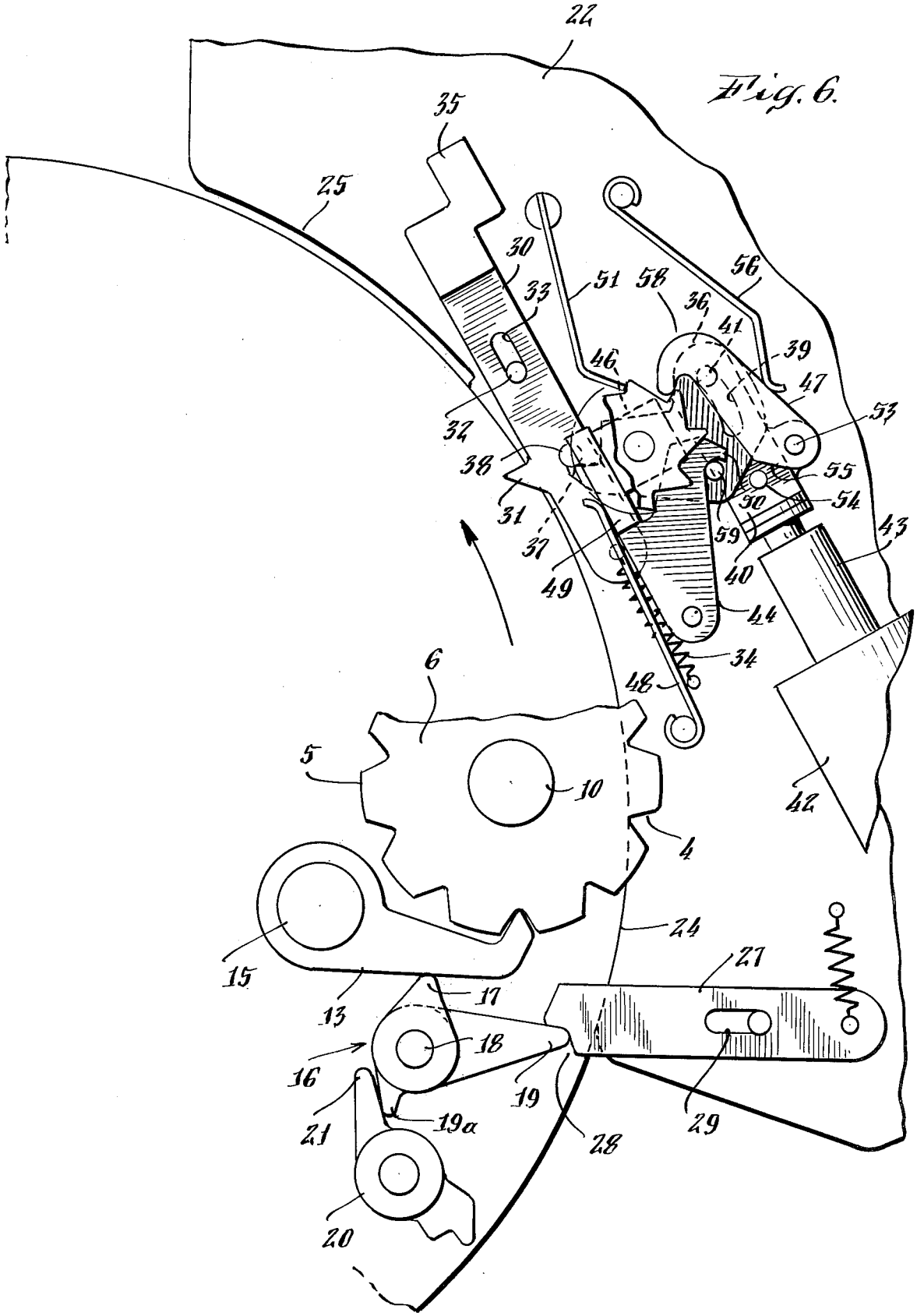
Figure 7:
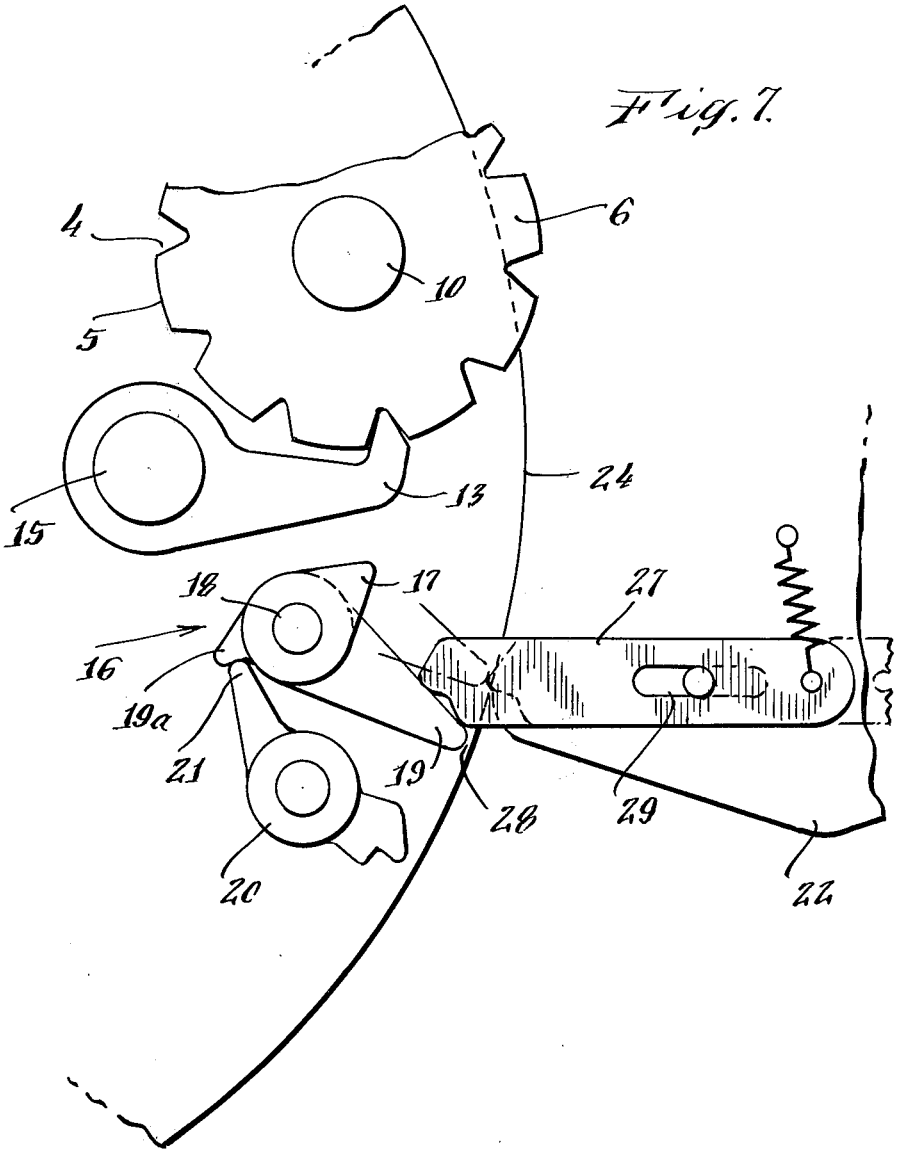

Referring now to FIG. 6, the drum is pictured returning toward its original position, and the inhibition apparatus is shown about to contact resetting link 27. In FIG. 6, cam 19 has just contacted link 27 at point 28. This interaction causes cam 19, cam 17, and arm assembly 16 to rotate clockwise. The lower edge **19*a* of cam 19 then begins to slide along cam 20 toward edge 21. Referring to FIG. 7, the printing drum has rotated a little further toward the rest position, and cam 19 has been driven clockwise enough so that edge 19*a* has slipped past edge 21 of cam 20, and cam 20 has again locked cam 19 and arm assembly 16**. The printing drum continues to rotate toward its rest position.

When the drum reaches its rest position, the outer edge of cam 19 will have slid past trigger 31, and the outer edge of cam 20 will come to rest just below trigger 31, because the operator has not yet had an opportunity to cancel the inhibition position of the latch apparatus. When the operator then signals the latch apparatus to unlock by again pulsing solenoid valve 42, latch 30 will be pulled downward by spring 34 and trigger 31 will slide past the outer edge of cam 20 and come to rest just below said edge, with the result being the situation we commenced with as pictured in FIG. 3.

Obviously, with suitable electrical control means, the inhibition mode of the latch apparatus could be automatically cancelled at the portion of the print cycle just after the print impressions have been made and before drum rotation is complete. In this manner, the operator would not have to cancel the inhibition mode after the printing cycle has been completed. In that instance, of course, when the drum has come to rest, the situation illustrated in FIG. 3 will be the end result.

There are obviously many variations and modifications which can be made to the print wheel bank inhibition apparatus and the latch apparatus, for example, the geometry of arrangement, means and method of mounting the various components, and different means for achieving the same purposes outlined herein, without departing from the scope of the invention disclosed. All of these variations are deemed to be within the spirit of the improvements just described.

What is claimed is:

1. An electro-mechanical latch apparatus which comprises:

a first latch mounted for linear movement in a support structure, and spring-biased in one direction;

a second latch rotatably mounted on said support structure, having a lockpin and a slot on one side of the rotation shaft, and an edge engaged with the first latch on the other side thereof;

an electrical pulse means having a shaft which is retractable into and out of said pulse means in response to an electrical signal;

a link assembly mounted on said pulse means shaft and movable linearly when the pulse means is energized, said link assembly comprising:

a first link mounted on said pulse means shaft having a pin which is positioned in the slot of said second latch;

a second link rotatably mounted on said first link, and spring-biased ro rotate toward said second latch, the second link having an angled end;

a third link rotatably mounted on the support structure and spring biased to rotate toward said link assembly, and having a first arm angled at the end thereof;

a toothed wheel having an edged cam affixed to the back thereof, rotatably mounted on the same axis of rotation as said second latch, wherein said edged cam contacts third link, and wherein the teeth of the wheel are engagable with the angled end of said second link of the link assembly when the pulse means shaft is retracted;

wherein, when said latch apparatus is in a first rest position, the edged cam forces said third link away from the lockpin of the second latch and the first latch rests in its biased position, and wherein, when the pulse means is energized a first time and said shaft retracts, the link assembly rotates the second latch, and the toothed wheel and edged cam, and moves the first latch against its bias, and permits the third link to rotate as biased, such that the angled end of the first arm thereof slides over and locks the lockpin of the second latch, thereby producing a second rest position wherein the first latch is locked beyond its biased position; and wherein when the pulse means is energized a second time the apparatus returns to its first rest position.

2. The latch apparatus of claim 1 wherein said third link has first and second arms extending in the same direction, and wherein said edged cam contacts said second arm of said third link.

3. The apparatus of claim 1 wherein the electrical pulse means is a solenoid valve.

4. The apparatus of claim 3 wherein said wheel has eight teeth and said edged cam is a square, and wherein a pulse of said solenoid valve causes the second link to rotate said wheel approximately 45°.

* * * * *